United States Patent [19]

Abramson et al.

[11] 4,435,032

[45] Mar. 6, 1984

[54] TERMINAL CONNECTOR WITH SAFETY DEVICE

[75] Inventors: Allen P. Abramson, Essex; Theodore R. Stiles, Somerset, both of N.J.

[73] Assignee: Challenger Circle F, Inc., Trenton, N.J.

[21] Appl. No.: 388,295

[22] Filed: Jun. 14, 1982

[51] Int. Cl.[3] ..... H01R 13/447

[52] U.S. Cl. ..... 339/36

[58] Field of Search ..... 339/36, 38

[56] References Cited

U.S. PATENT DOCUMENTS 3,810,020 5/1974 Ludwig ..... 339/36

3,879,098 4/1975 Lawrence et al. ..... 339/41

4,094,569 6/1978 Dietz ..... 339/40

4,206,957 6/1980 Ludwig et al. ..... 339/40

*Primary Examiner*—Joseph H. McGlynn

*Assistant Examiner*—Paula Austin

*Attorney, Agent, or Firm*—Frederick A. Zoda; John J. Kane

[57] ABSTRACT

A terminal connector for electrical extension cords include a safety cap characterized by requiring apposable or gripping motion to expose to electrical ports of the connector. Most adults are able to correctly manipulate the safety cap but children do not have necessary strength and coordination.

12 Claims, 3 Drawing Figures

TERMINAL CONNECTOR WITH SAFETY DEVICE

BACKGROUND OF THE INVENTION

This invention pertains to terminal connectors of electrical extension cord sets, and, more particularly is concerned with terminal connectors having protective safety devices.

The ubiquitary extension cord needs little introduction as to its use or function. A complete extension cord includes a plug, usually having two prongs; a cord, usually a pair of insulated wires several feet in length; and a terminal connector for receiving one or more electrical plug to power lamps, radios and television sets, small appliances and the like.

Extension cords are found in nearly every home, and by their nature are usually strung at floor level. This poses a danger to inquisitive young children, a population known to probe or ingest almost every conceivable object. The terminal connector may have unused ports into which conductive foreign objects such as paper clips, pins, and the like can be inserted. Such activity can easily result in electrical shock, injuring or perhaps killing the child. This danger has been recognized and extension cord manufacturers are providing safeguards in attempts to frustrate such misuse.

A common approach is the use of a pseudo-twin prong plug which blocks unused ports. Unfortunately youngsters appear to have no more difficulty than adults in removing this device.

Another approach is the use of a disc rotatably mounted to cover the electrical ports. The disc has slots which can be brought into register with the electrical ports. One such arrangement is described in U.S. Pat. No. 3,879,098 issued to Lawrence and Martin. This approach has been said to be more successful than the pseudo-twin prong plug, but can still be defeated by use of a foreign object to turn the disc.

Yet another approach is the use of movable plates to cover the electrical ports. The plates have slots which are intended to be misaligned with unused ports. One such arrangement is described in U.S. Pat. No. 3,810,070 issued to Ludwig. The plate is held to the connector body by flanges molded in the body. The body is resilient and urges the plate to a misaligned position. U.S. Pat. No. 4,094,569 issued to Dietz is another movable plate arrangement. Here the plate is secured to the connector body by a central barbed stake and is biased by a separate bowed spring. In the latter two arrangements, prongs of a plug are used as a tool to align the slots and ports for insertion of the plug. U.S. Pat. No. 4,206,957 issued to Ludwig and Tansi describes a plate guard molded with an integral spring approximately perpendicular to the center of the plate. The free end of the spring is inserted into the connector body and retains the cover. The plate is knurled on one side to facilitate manual manipulation of the plate.

All of the above safeguards do offer some protection from the danger of electrical shock. Unfortunately these safeguards can be defeated by unidirection movement of the covering member, and upon such a defeat, access to both electrical ports occurs simultaneously.

It will be appreciated that an ideal safeguard should be activated only by movement which is easy for an adult and difficult for a child.

A primary object of the invention is to provide a terminal connector having a safety cap, and which requires, for successful manipulation, the apposable capacity of the adult hand for which children lack the necessary strength and coordination.

A second object of the invention is to provide a terminal connector with a safety cap having features assuring proper and secure assembly of its components.

SUMMARY OF THE INVENTION

Briefly, this is to provide a terminal connector, for electrical extension cords, having a connector body of insulating material embedding electrical contacts. Passageways communicate with the contacts. A safety cover is attached to the body. The cover has two holes which normally block access to the contacts. Each half has a blocking plate with a hole sized to pass a plug prong. The two halves must be pushed together against the tension of a spring or the like in order until the holes and passageways are aligned for access to the contacts so that a plug may be inserted.

The body may have walls to guide the movement of the halves. As the halves are pushed towards each other, the body plates left from the body reduce friction. The halves are normally pushed apart by a bifurcate leaf spring within a channel provided in the body, separating the blocking plates. The leaves are provided with relief so their thickness won't interfere with the plates being pushed together. Each half may also include a gripping plate to facilitate manipulation of the blocking plates. The cap may be secured to the body by barbs extending from the gripping plates and bifurcate spring into the body. Both the cap and the body may be sized to accept polarized plugs in which case the barbs on the gripping plates are sized differently to ensure contact assembly.

DESCRIPTION OF THE INVENTION

Figure 1:
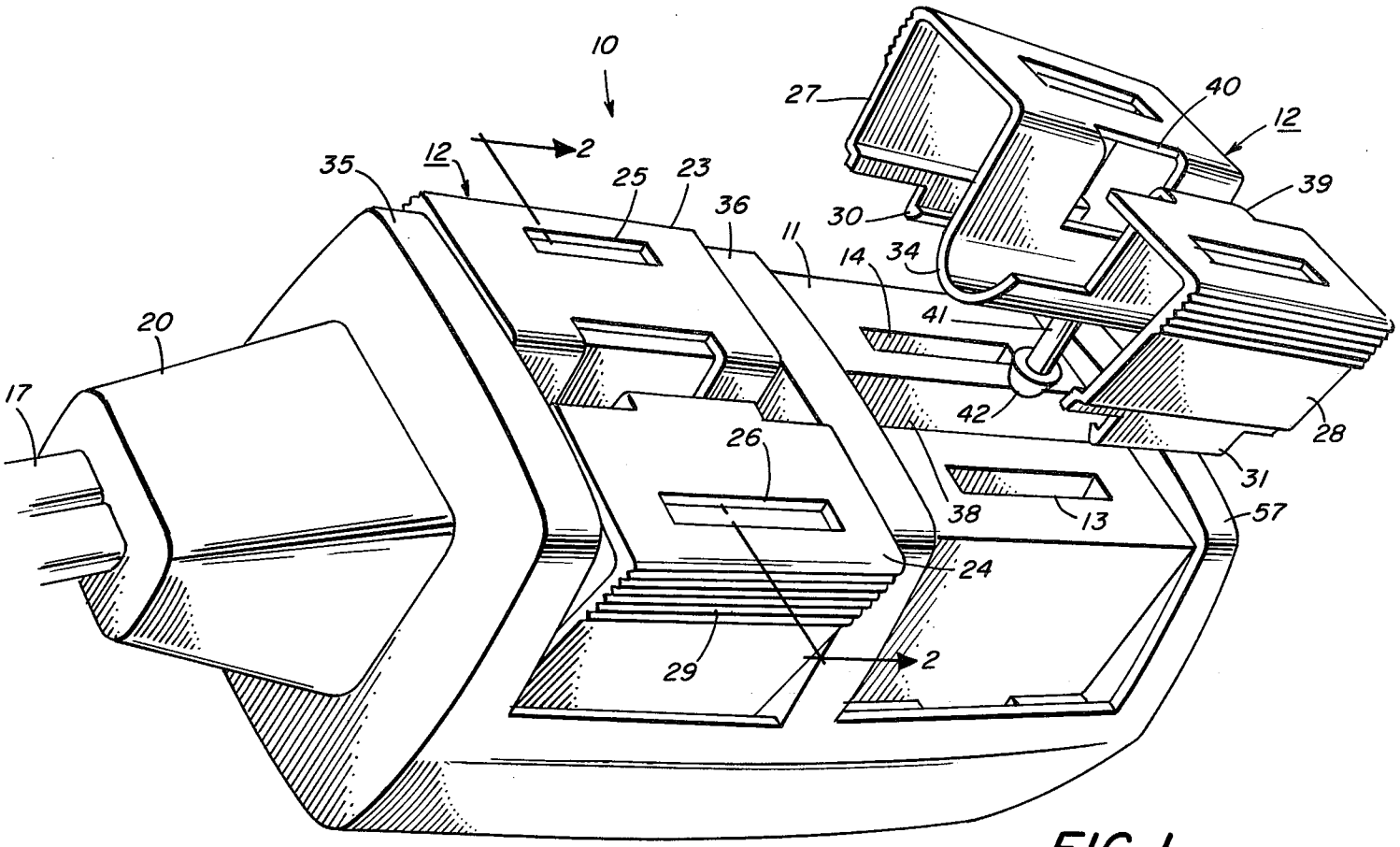
FIG. 1 is a view of a terminal connector according to the invention.

FIG. 1 illustrates a terminal connector 10 for extension cords embodying the preferred embodiment of the invention. The connector 10 includes a terminal body 11, at least one safety cover 12 and at least one pair of ports 13, 14 to receive the prongs of an electrical plug (not shown). It is now customary for terminal connectors to have three pairs of ports, two of which are provided with safety covers.

Figure 2:
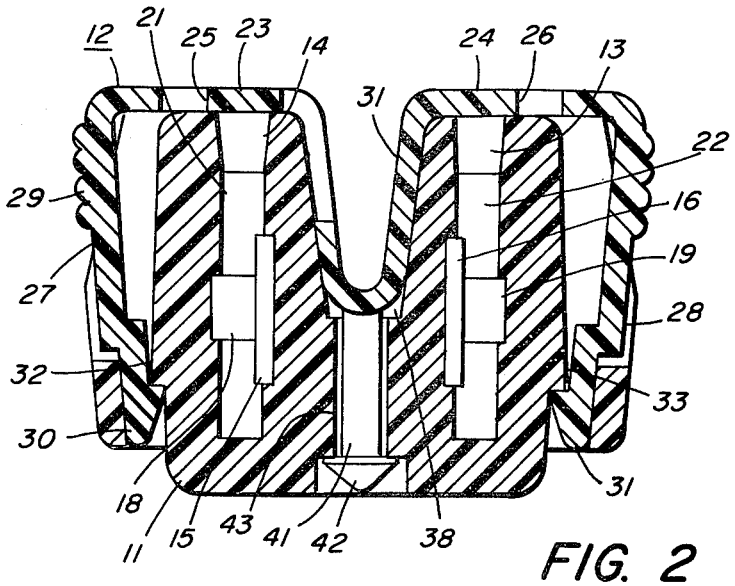
FIG. 2 is a cross section view of the connector with its safeguards in its normal position.
Figure 3:
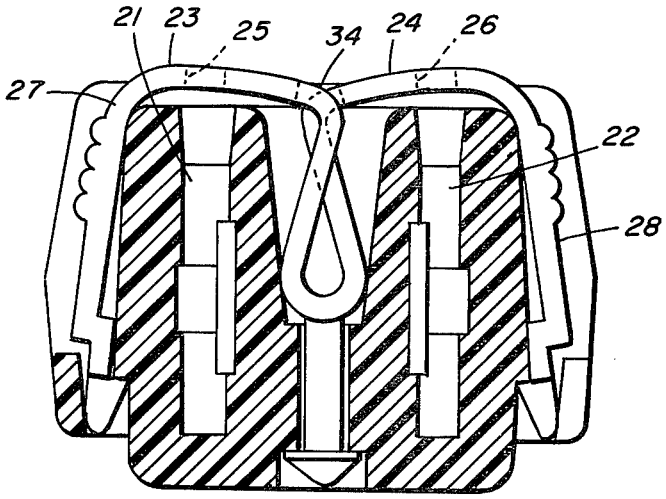
FIG. 3 is the same cross sectional view but with the safeguard in its open position.

The general construction of terminal connectors is well known and will only be briefly described. Internal to the connector body as seen in FIGS. 2 and 3 is a pair of parallel conductor strips 15, 16 which are crimped or otherwise attached to the end of an electrical cord (17 of FIG. 1). The conductor strips 15 and 16 have female probe receiving contacts 18, 19 for making electrical contact to the prongs of an electrical plug.

Each conductor strip usually has three such probe receiving contacts so that the terminal connector has three pairs of contacts. The connector body is molded on the end of the cord and embedding the conducting strips. The body 11 is made of an electrically insulating material preferably an elastomer plastic (i.e. a polyvinylchloride), and is generally rectangular with a tapered strain relief 20 for the cord 17. Passageways 21, 22 are molded in alternate sides of the body 11 to provide access to the contacts 18, 19. For the purposes of this description the combination of a passageway and a contact is called a port and a plug requires two ports. Two pairs of ports are located on one side of the body with a third pair located on the opposite side (not seen). In the example shown in FIG. 1, safety caps are provided only for the two pairs of ports on the same side of the body, as it is assumed that the third pair will be plugged when the extension cord is in use.

The above written description is inclusive of a number of terminal connectors both well known and in public use. The description shall now be directed to include these features of the invention believed to depart from the teachings of the prior art.

In keeping with the invention a plurality of safety covers may be used, each safety cover having identical functions and construction. Preferably, a safety cover is one piece of molded plastic, such as nylon. In FIG. 1 on safety cover is shown prior to assembly as an aid to understanding the invention.

As a feature of the invention a safety cover 12 has two blocking plates 23, 24 arranged on the connector body to cover corresponding ports 13, 14. The blocking plates 23, 24 are mechanically biased apart by a resilient spring 34 or the like.

Each blocking plate 23, 24 has a prong receiving hole 25, 26 through which a plug prong can pass when the safety cover 10 is correctly manipulated.

The prong receiving holes 25, 26 are however normally misaligned with passageways 21, 22 and the blocking plates 23, 24 deny access to the electrical contacts within the connector body 11 as best seen in FIG. 2.

Each blocking plate is coupled to a gripping plate 27, 28. The gripping plates are arranged in spaced relation to opposite sides of the connector body so they may be squeezed towards each other. Ribs 29 ensure a good grip. Each gripping plate 27, 28 may have a barbed member 30, 31 for insertion in a corresponding hole 32, 33 in the connector body 11.

When access to the electrical contacts is desired, that is to say, when a plug is to be inserted, it is necessary to group the safety cover 12 with a thumb and finger and apply apposable pressure against the gripping plates 27, 28 thereby urging the blocking plates 23, 24 towards each other until the prong receiving holes 25, 26 are aligned with their corresponding passageways 21, 22 as seen in FIG. 3.

As an additional feature of the invention, the blocking plates 23, 24 preferably do not maintain contact with the connector body 11 when pushed together. This arrangement reduces drag and friction, and thereby reduces the amount of force required to manipulate the safety cover making the most significant resistance is the spring tension caused by deforming spring 34.

Each blocking plate works independently of the other, therefor greater coordination is needed to insert the plug than is the case for previous safety guards having a single two holed blocking plate. This feature increases the difficulty for a young child to successfully defeat the safety cover. Furthermore, the placement of the thumb and finger on the sides of the connector prevent the possibility of only one prong be inserted with the other prong exposed on the side of the connector.

When a plug is removed, or when pressure on the gripping plates is relaxed, tension in the deformed spring 34 returns the blocking plates 23, 24 to their original position, thereby restructing insertion of a plug or other foreign object.

As an additional feature of the invention, the connector body may be molded with parallel raised walls 35, 36, 37 contiguous to the sides of the blocking plates. These walls guide and control the movement of the blocking plate, and prevent any areas on either side of the blocking plates to be exposed by insertion of foreign objects, or saliva flow should a child place the terminal connector in his or her mouth.

To accept conventional prongs which are formed as flat blades, both the prong receiving holes and the passageways are slots.

In keeping with current practice, each pair of electrical ports is polarized so that a polarized plug can be inserted only one way. One prong of a polarized plug is slightly larger than the other. Thus one pair of prong receiving hole and passageway is also slightly larger than the other. As an additional feature of the invention, the barbed members 30, 31 on the gripping plates may have different dimensions assuring correct assembly of the polarized cover and connector body. As shown the barb members are preferably rectangular stakes having different widths for insertion into slots 32,33. The barbs face inward so as not to distort the body when the cover is compressed.

As yet another feature of the invention, the blocking plates 23, 24 are pushed apart by a "V" or "U" shaped bifurcated leaf spring 34 interposed between the blocking plates. The connector body 11 is molded with an elongated groove 38 between passageways for accommodating the spring 34. The area of the bifurcated spring adjoining the blocking plates may be provided with complementing relief (i.e. tenon 39 and mortise 49) allowing the blocking plates to be pushed together without being limited by the thickness of the spring leaves.

A barbed member, shown as a shaft 41 terminating in a frustum of a cone 42 may extend from the spring 34 for anchoring in a corresponding hole 43 provided in the connector body 11.

The safety cover can be made with barbed members on just the spring, or on just the gripping plates. It is preferable, however, to provide all three barbed members to anchor or attach the safety cover to the connector body at three points to ensure proper movement on spring back tension of the safety cover, as well as to secure permanence of the assembly.

Although the preferred embodiment of the invention was described it should be considered as exemplary, with numerous modifications being within the scope of the invention as defined by the claims.

We claim:

1. A terminal connector for electrical extension cords comprised of:

(a) a connector body, of electrically insulating material, including a pair of prong receiving contacts internal to said connector body; and a pair of prong receiving passageways communicating with said contacts; and (b) a safety cover, of electrically insulating material, attached on said connector body, said safety cover including: two blocking plates, each blocking plate covering one of said passageways and having a prong receiving hole; biasing means for resiliently separating said blocking plates, normally causing corresponding prong receiving holes and passageways to be misaligned thereby preventing access to said prong receiving contacts; and gripping means for manually urging said blocking plates together thereby aligning corresponding prong receiving holes and passageways allowing access to said prong receiving contacts.

2. The terminal connector of claim 1 wherein said connector body includes parallel raised walls, each wall contiguous to one side of each blocking plate for guiding movement of said blocking plates.

3. The terminal connector of claim 1 wherein said blocking plates, when urged together, are in spaced relation to said connector body.

4. The terminal connector of claim 1 wherein said biasing means is a bifurcated leaf spring interposed between said blocking plates and wherein said connector body includes an elongaged channel between said passageways for accommodating said bifurcated leaf spring.

5. The terminal connector of claim 4 wherein areas of said bifurcated leaf spring adjoining said blocking plates are provided with complementary relief allowing said blocking plates to be urged together without interference from the thickness of said bifurcated spring.

6. The terminal connector of claim 4 which further includes a barbed member extending from said bifurcated spring; and said connector body having a member receiving hole arrayed from receiving said member.

7. The terminal connector of claim 1 wherein said gripping means is a pair of gripping plates; each gripping plate coupled to one of said blocking plates, said pair of gripping plates arranged in spaced relation to opposite sides of said connector body so allowing simultaneous actuation of said blocking plates by finger and thumb pressure.

8. The terminal connector of claim 7 which further includes a barbed member extending for each gripping plate; and said connecting body including member receiving holes array for receiving said members.

9. The terminal connector of claim 8 wherein said barbed members extending from said gripping plates are rectangular barbed stakes and said member accepting holes are slots.

10. The terminal connector of claim 9 wherein the widths of each pair of rectangular barbed stake and member accepting holes are different.

11. The terminal connector of claim 1 wherein said safety cover is one piece of molded plastic; said gripping means is a pair of gripping plates, each gripping plate coupled to one of said block plates; and said biasing means is a bifurcated spring interposed between said blocking plates and wherein said connector body includes an elongaged channel between said passageway for accommodating said bifurcated spring.

12. The terminal connector of claim 11 which further includes a barbed member extending from each gripping plate; a barbed member extending from said bifurcates spring; and said connector body including member receiving holes arranged for receiving said members, thereby anchoring the safety cover to the connector body in three places.

* * * * *

UNITED STATES PATENT AND TRADEMARK OFFICE

CERTIFICATE OF CORRECTION

PATENT NO. : 4,435,032

DATED : Mar. 6, 1984

INVENTOR(S) : Allen P. Abramson and Theodore R. Stiles

It is certified that error appears in the above–identified patent and that said Letters Patent are hereby corrected as shown below:

Column 3, Line 19, change "on" to -- one --

Signed and Sealed this

*Second* Day of *October 1984*

[SEAL]

*Attest:*

GERALD J. MOSSINGHOFF

*Attesting Officer*

*Commissioner of Patents and Trademarks*